US010167770B1

(12) United States Patent
Ames

(10) Patent No.: US 10,167,770 B1
(45) Date of Patent: Jan. 1, 2019

(54) AUTOMOTIVE WATER PUMP SPACER WITH VOLUTE EXTENSION

(71) Applicant: Paragon Technology, Inc., Gilbert, AZ (US)

(72) Inventor: Christopher W. Ames, Gilbert, AZ (US)

( * ) Notice: Subject to any disclaimer, the term of this patent is extended or adjusted under 35 U.S.C. 154(b) by 0 days.

(21) Appl. No.: 15/909,791

(22) Filed: Mar. 1, 2018

Related U.S. Application Data

(60) Provisional application No. 62/557,736, filed on Sep. 12, 2017.

(51) Int. Cl.
*F01P 5/10* (2006.01)
*F01P 7/14* (2006.01)
*F02B 67/06* (2006.01)

(52) U.S. Cl.
CPC ..... *F01P 5/10* (2013.01); *F01P 7/14* (2013.01); *F02B 67/06* (2013.01)

(58) Field of Classification Search
CPC ..... F01P 5/10; F01P 7/14; F01P 11/00; F04D 29/40; F04D 29/422; F04D 29/428; F04D 5/007
USPC ..... 417/423.14
See application file for complete search history.

(56) References Cited

U.S. PATENT DOCUMENTS 5,375,970 A * 12/1994 Iwai ..... F04D 5/002 415/169.1
5,486,087 A * 1/1996 Treiber ..... F02M 37/048 415/55.1
5,785,490 A * 7/1998 Dobler ..... F04D 5/002 415/55.1
6,336,788 B1 * 1/2002 Fujii ..... F02M 37/048 415/55.1
8,087,876 B2 * 1/2012 Inuzuka ..... F04D 5/002 415/55.1
8,956,130 B2 * 2/2015 Buzit ..... F04D 9/008 417/423.3

* cited by examiner

*Primary Examiner* — Hung Q Nguyen
*Assistant Examiner* — Mark L. Greene
(74) *Attorney, Agent, or Firm* — Thomas W. Galvani, P.C.; Thomas W. Galvani

(57) ABSTRACT

A spacer for coupling a water pump to a timing chain cover on an automotive engine includes a body having an upstanding sidewall with opposed front and rear faces. The sidewall bounds an interior chamber, and a ramp is formed to the sidewall. The ramp extends into the interior chamber from the rear face to the front face.

18 Claims, 5 Drawing Sheets

AUTOMOTIVE WATER PUMP SPACER WITH VOLUTE EXTENSION

CROSS-REFERENCE TO RELATED APPLICATIONS

This application claims the benefit of U.S. Provisional Application No. 62/557,736, filed Sep. 12, 2017, which is hereby incorporated by reference.

FIELD OF THE INVENTION

The present invention relates generally to engines, and more particularly to gasoline automotive engines.

BACKGROUND OF THE INVENTION

The Ford Thunderbird is a quintessential American car with a manufacturing run spanning five decades, beginning in 1954. The first generation of the Thunderbird, or "T-Bird" as enthusiasts call them, used a Y-block engine, which is an overhead valve eight cylinder engine. This early T-Bird engine is notorious for overheating. Even new cars were known to overheat during city driving in mild temperatures.

For sixty years, owners have been bothered by this issue. A number of causes have been suspected, but no solution has yet to address the real problem.

In looking for the problem, some owners delve deeply into the design history of the Y-block: they blame Ford's cobbling together of engine parts from its other vehicles. At the front of the engine, attached to the timing chain cover, is a water pump originally designed for and used in Ford's passenger cars. To accommodate the slight difference in dimension, and to ensure pulleys and belts were aligned, Ford introduced a spacer between the timing chain cover and the water pump. Many people blame overheating on the inability of the water pump to fill the enlarged void created by the spacer. In other words, many owners believe that the original water pump is not strong enough to pump a sufficient flow of coolant through both the engine and the additional volume behind the water pump created by the spacer. Their solution has been to replace the original water pump with a high volume one in an attempt to push more coolant through the engine. While this may result in a T-Bird less prone to overheating, the underlying problem remains.

Some owners believe that the water pump has simply broken or become worn, and they may replace it. They usually replace it with a modern water pump or higher output pump. In some cases, this reduces the symptoms, but unfortunately it does not address the underlying design issue; as their replacement pumps wear and move less coolant, the underlying problem returns.

Others blame poor maintenance. A cooling system needs to be drained and flushed regularly, and failure to do so can allow rust and sludge to build up within the tubes and passageways through which coolant flows. Supporters of this "dirty cooling system" theory advocate cleaning out those tubes and passageways so that coolant may flow faster and more smoothly. Interestingly, some people believe just the opposite; that moving coolant through the engine too quickly can result in the coolant not drawing enough heat away from the engine. Of course, neither of these theories addresses why clean and new T-Birds could overheat and stall on the drive home from the dealership.

Still other people source the problem to the way the engine is installed in the car. The large Y-block engine fits inside a relatively small engine compartment. In this cramped space, air flows less freely around the engine, thereby reducing the amount of heat transfer at the radiator, and thus preventing the coolant from cooling sufficiently.

The overheating problem is peculiar to the first generation of T-Birds, and most owners have pursued solutions to the wrong causes of the problem. A device which questions the problem correctly, and answers that question, is still needed.

SUMMARY OF THE INVENTION

A spacer for coupling a water pump to a timing chain cover on an automotive engine includes a body having an upstanding sidewall with opposed front and rear faces. The sidewall bounds an interior chamber, and a ramp is formed to the sidewall. The ramp extends into the interior chamber from the rear face to the front face. This ramp directs and conditions the flow of coolant within the interior chamber in a way that prevents overheating of the engine.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
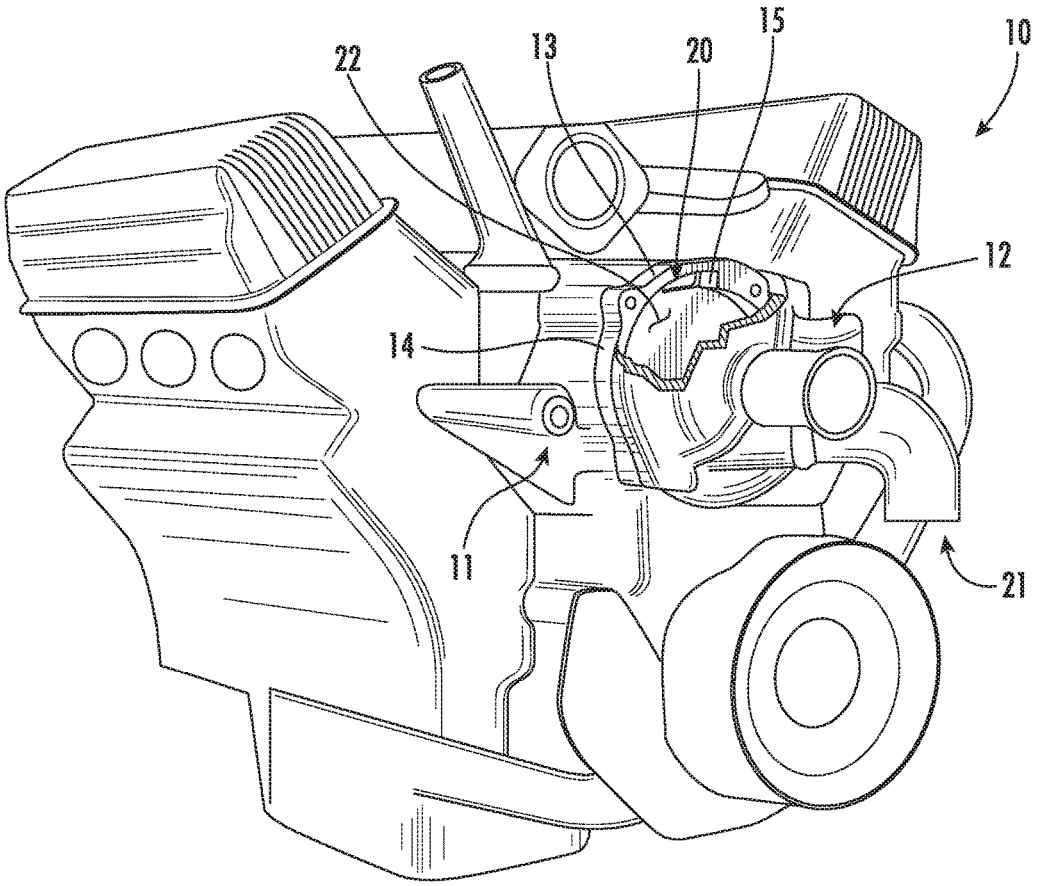
FIG. 1 (PRIOR ART)
FIG. 1 is a front perspective view of an automotive engine having a timing chain cover, a water pump, and a conventional spacer therebetween.

Reference now is made to the drawings, in which the same reference characters are used throughout the different figures to designate the same elements. FIG. 1 illustrates a conventional Y-block engine 10 for a Ford Thunderbird, the engine 10 having a front end mounted with a timing chain cover 11, a water pump 12, and a conventional spacer 13 disposed therebetween. The conventional spacer 13 includes an upstanding sidewall 14 and a notch 15 disposed above a volute entrance 20 in the timing chain cover 11. Coolant flows into the water pump 12 through an inlet (shown here opened for simplicity), circulates in an interior chamber 22 at the spacer 13 defined between the water pump 12 and the timing chain cover 11, and then exits through the volute entrance 20, from which it is communicated throughout the engine 10. An impeller carried on the back of the water pump 12 rotates to draw coolant through the inlet 21, move it around the chamber 22, and to communicate it back into the volute entrance 20.

Although shown in FIG. 1 at essentially eye level, when mechanics, gearheads, and car enthusiasts work on engines such as the illustrated engine 10, they encounter the engine 10 from a much different perspective. First, there are many more lines, belts, pulleys, and other mechanical equipment surrounding the engine 10 than shown here. Second, early versions of the Ford Thunderbird had a notoriously small engine compartment compared to the size of the engine. Third, the person usually eyes the engine 10 from only a few vantage points: from directly above, or from above and just slightly in front or to the side, or from directly underneath. Fourth, FIG. 1 shows the water pump 12 partially eroded, such that the conventional spacer 13 and the timing chain cover 11 behind the water pump 12 are visible; this of course would never occur in the real world, because the water pump 12 is always viewed whole unless there has been absolutely catastrophic damage to the engine 10, rendering it inoperative. In short, when the engine is arranged in an operational condition, the chamber 22 between the water pump 12 and the timing chain cover 11 is neither visible nor accessible, and so the fluid dynamics within the chamber 22 are unknown.

When the spacer 13, the chamber 22, and the timing chain cover 11 behind the water pump 12 are visible, it is only because the engine 10 has been pulled out of the engine compartment. In such a situation, the engine 10 would not be in an operational condition, because the water pump 12 inlet 21 would have to be disconnected, and thus no coolant could circulate through the engine 10. In other words, the illustration of FIG. 1 shows a state of visibility of the engine 10 in which it would never be. And even in such a state, the volute entrance 20 would not be visible, because to see it would require the observer to be slightly underneath and in front of the engine 10 with his line of sight not blocked by the water pump 12 or the large pulleys below it. As such, the construction of the timing chain cover 11, the water pump 12, and the spacer 13 are not encountered by the observer.

Figure 2:
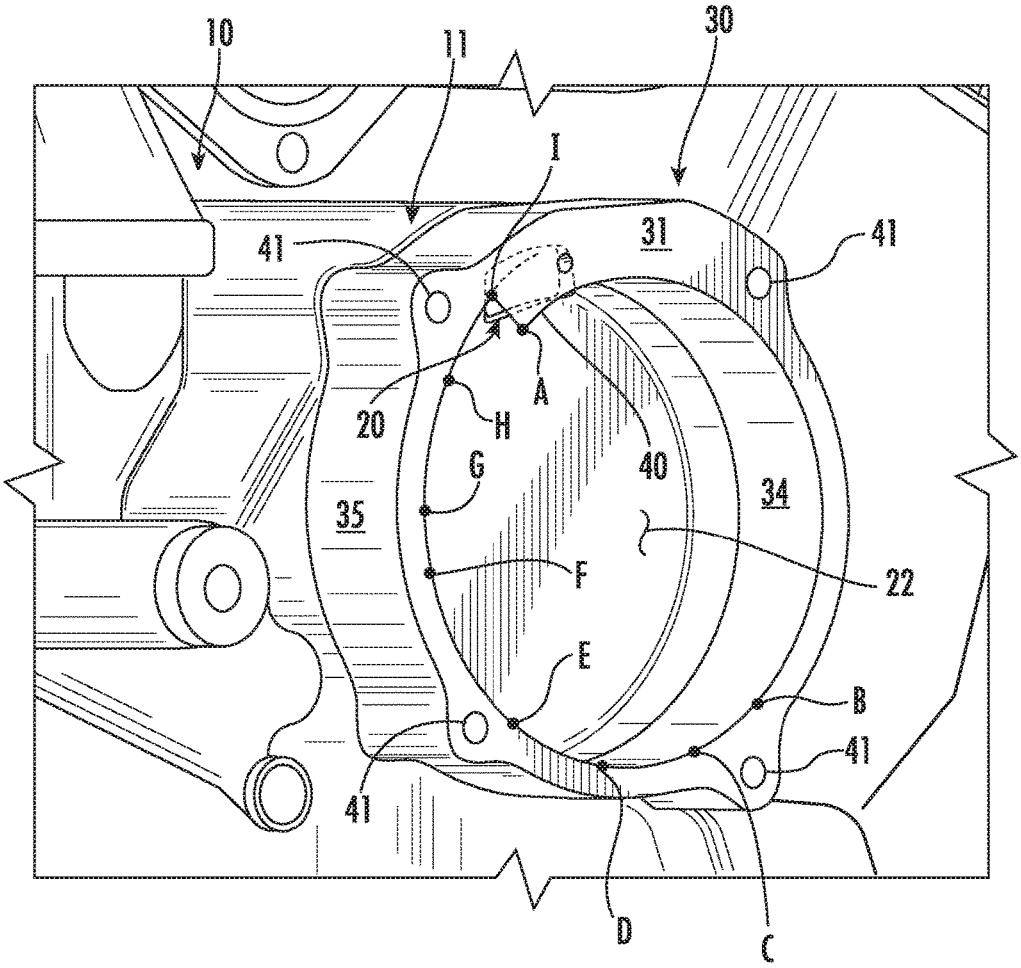
FIG. 2 is an enlarged, perspective view of an automotive water pump spacer with volute extension applied to the timing chain cover of an automotive engine similar to that of FIG. 1.

FIG. 2 illustrates, in enlarged detail, an improved water pump spacer 30 ("spacer 30") applied to the conventional timing chain cover 11 of the conventional engine 10. The spacer 30 is applied in the same location as the conventional spacer 13 and serves to offset the water pump 12 a forward distance off the timing chain cover 11. For clarity, the water pump 12 is not shown in this illustration, as it would be applied to the front face of the spacer 30 and would substantially hide the spacer 30 in this view. Briefly, it is noted here that the terms "forward," "front," "ahead" and the like are used to indicate direction or directionality between structures or features, in a direction from the timing chain cover 11 toward the water pump 12, generally (and toward the front of the car). Conversely, the terms "rearward," "rear," "behind" and the like are used to indicate direction or directionality between structures or features, in a direction from the water pump 12 toward the timing chain cover 11, generally (and toward the back of the car). For example, the spacer 30 is forward of, or in front of, or ahead of the timing chain cover 11 and the engine 10.

Figure 3:
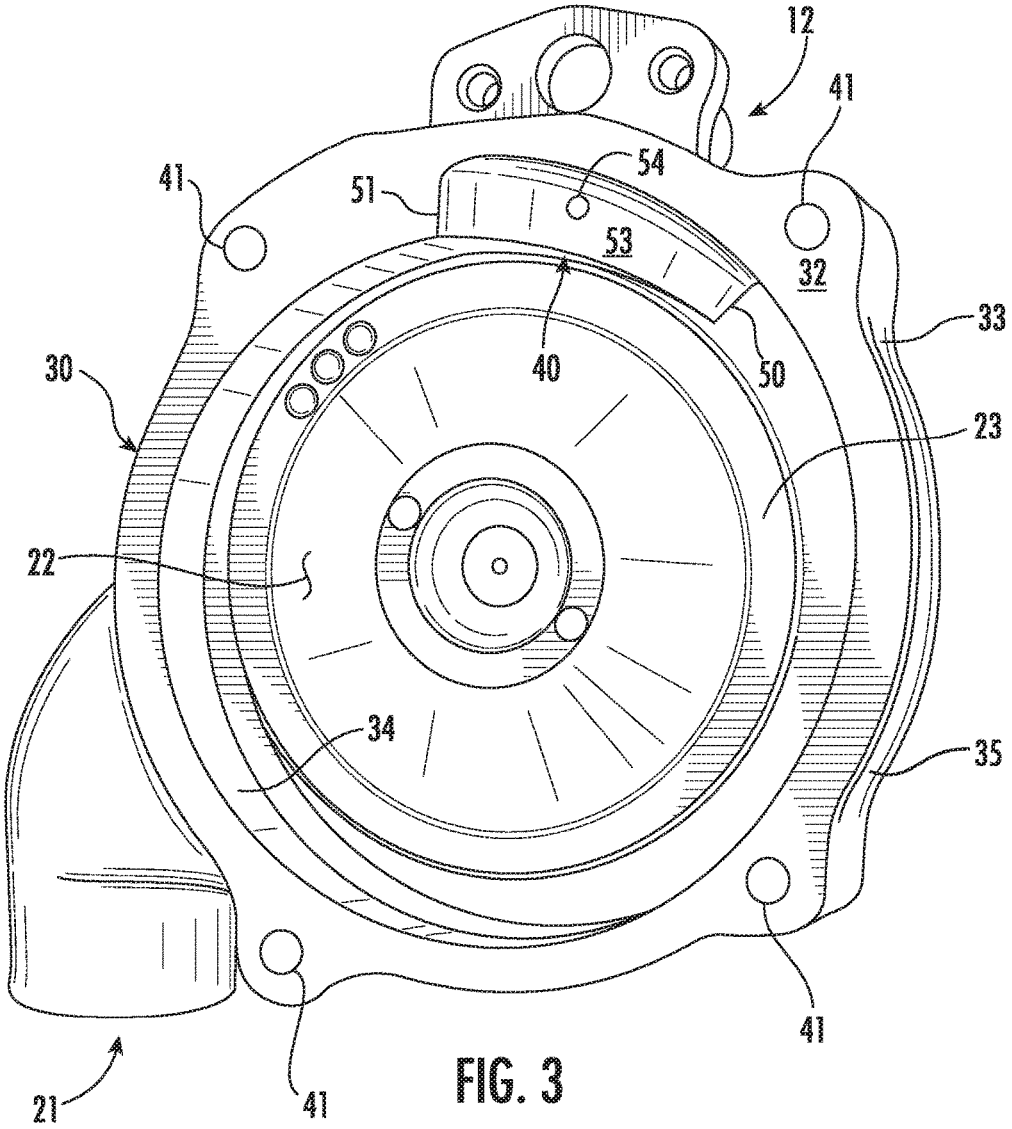
FIG. 3 is an isolated perspective view of the spacer of FIG. 2 applied to the back of a water pump.

FIG. 3 is a rear view illustrating the spacer 30 applied to the back of the water pump 12. Again, the spacer 30 is applied in the same location as the conventional spacer 13 would be applied on the back of the water pump 12. In FIG. 3, an impeller 23 of the water pump 12 is also shown. The spacer 30 closely encircles the impeller 23 with a narrow annular gap defined between.

Figure 4:
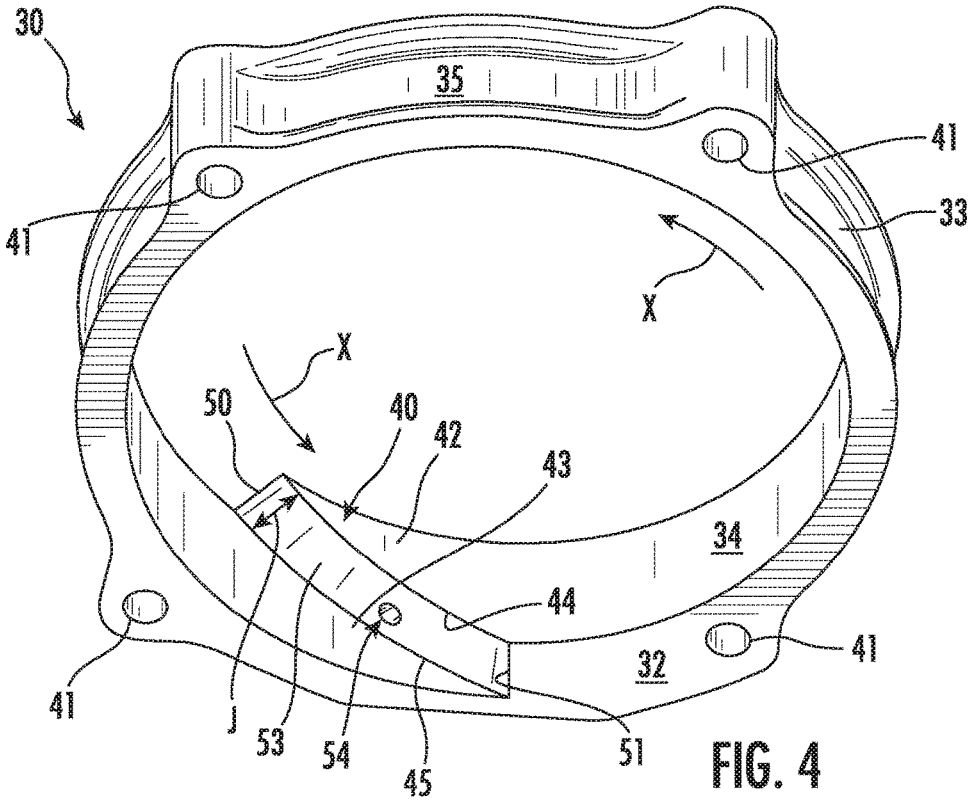
FIGS. 4 and 5 are isolated rear and front perspective views, respectively, of the spacer of FIG. 2.
Figure 5:
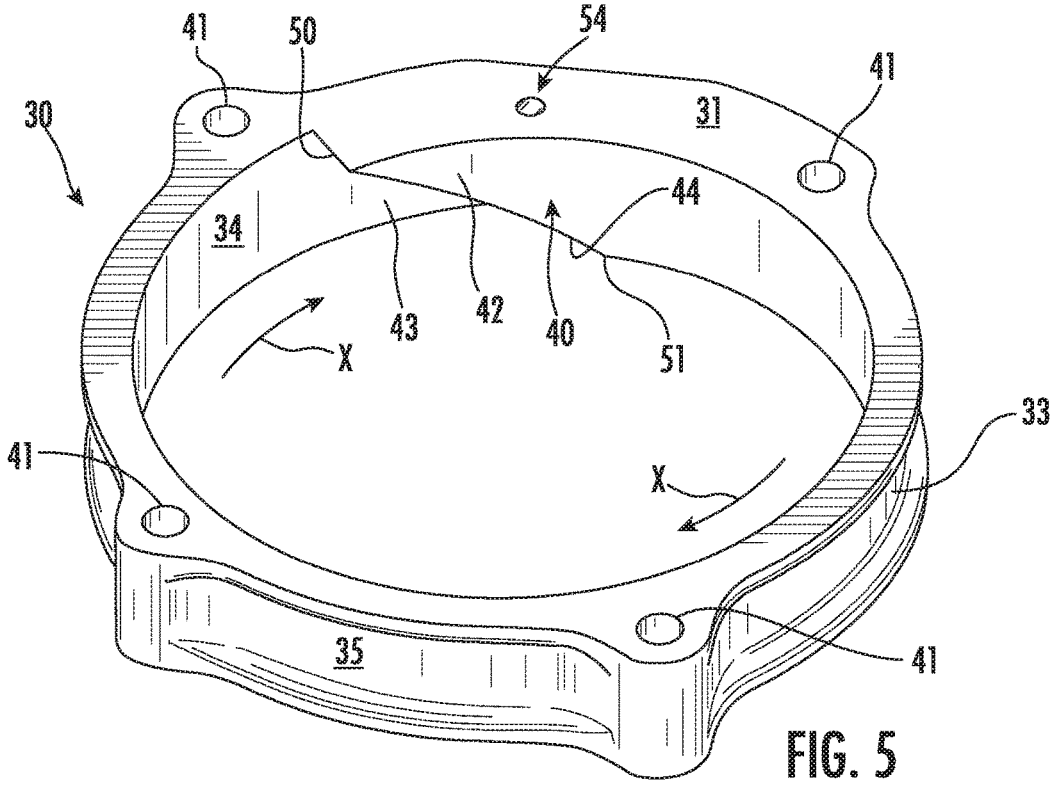

Turning to FIGS. 4 and 5, the spacer 30 is shown in detail in rear and front perspectives, respectively. The spacer 30 has a front face 31 and an opposed rear face 32, with the upstanding annular sidewall 33 extending therebetween. The sidewall 33 has opposed, annular inner and outer surfaces 34 and 35. The outer surface 35 flares radially outward at four locations to accommodate bolts, and also flares radially outward between those four locations at only the front and rear faces 31 and 32, so as to form projections or quartered flanges proximate the front and rear faces 31 and 32.

While the outer surface 35 is continuous, the inner surface 34 is severed or interrupted by a ramp 40 extending circumferentially between the front and rear faces 31 and 32. The ramp 40 extends circumferentially on the sidewall 33 in that it extends around an arc or circular portion of the sidewall 33 defined as a portion of a circumference of the inner surface 34. However, the ramp 40 is formed onto the inner surface 34, and interrupts and severs it to define leading and trailing portions 42 and 43 of the inner surface 34, as will be explained in more detail later. But for the ramp 40, the inner surface 34 is smooth and extends between the front and rear faces 31 and 32 in a straight and direct fashion normal to both the front and rear faces 31 and 32.

The front face 31 of the spacer 30 is directed forward, and mates in direct and flush contact with the water pump 12. The front face 31 is roughly annular, defined roughly by an outer circle and an inner complex but generally circular shape. The front face 31 is smooth, flat, and planar, lying in a single plane approximately normal to the sidewall 33 forming it.

The rear face 32 of the spacer 30 is directed rearward, and mates in direct and flush contact with the timing chain cover 11. The rear face 32 is roughly annular, defined roughly by an outer circle and an inner complex but generally circular shape. The rear face 32 is smooth, flat, and planar, lying in a single plane approximately normal to the sidewall 33 forming it. As such, the front and rear faces 31 and 32 are parallel to each other, and the spacer 30 has a squat, substantially regular tubular shape.

Still referring to FIGS. 4 and 5, bores 41 extend through the sidewall 33 in four circumferentially spaced-apart locations, corresponding to a bolt pattern in the timing chain cover 11 and water pump 12. The bores 41 receive bolts for binding the water pump 12 and spacer 30 to the timing chain cover 11. While the sidewall 33 is substantially annular, it flares radially outward at the bores 41 to form aggressive surrounds or protrusions around each of the bores 41. Between the bores 41, the outer surface 35 of the sidewall 33 is concave between the quartered flanges described above, wherein front and rear edges of the sidewall 33—proximate to the front and rear faces 31 and 32—flare slightly, and the middle portion of the outer surface 35 of the sidewall 33 is set back slightly. This provides the sidewall 33 with strength and rigidity, and provides a larger surface area to mate the spacer 30 to the timing chain cover 11 and the water pump 12.

The inner surface 34 of the sidewall 33 is smooth. The inner surface 34 wraps around the inside of the sidewall 33 until it reaches the ramp 40. Though the inner surface 34 appears to be generally circular, it is in fact made up of several smaller portions of a circle, or arcs. Referring now to FIG. 2, a number of points A through I are identified in the illustration on the inner surface 34. Arcuate lines between neighboring points define arcs, each with a different and unique radius. Thus, while the spacer 30 has a single geometric center, each of the arcs of the inner surface 34 has a different geometric center to which a respective radius extends. A first arc, A-B, extends between points A and B along the inner surface 34; this arc is semi-circular, and, were it extended, would form a complete circular back at point A. However, the second arc, B-C, extending between points B and C, has a larger radius than arc A-B with an offset center. The third arc, C-D, extending between points C and D, has a larger radius than arc B-C with an offset center. The fourth arc, D-E, extending between points D and E, has a larger radius than arc C-D with an offset center. The fifth arc, E-F, extending between points E and F, has a larger radius than arc D-E with an offset center. The sixth arc, F-G, extending between points F and G, has a larger radius than arc E-F with an offset center. The seventh arc, G-H, extending between points G and H, has a larger radius than arc F-G with an offset center. The eighth and final arc, H-I, extending between points H and I, has a larger radius than arc G-H with an offset center. As such, the inner surface 34 is smooth but gradually expands radially to take on a complex, generally circular, yet non-circular shape. The leading edge of the ramp 40 extends between points I and A.

Returning to FIGS. 4 and 5, because the ramp 40 interrupts the inner surface 34, the inner surface 34 has a leading portion 42 and a trailing portion 43 which are radially offset or radially spaced apart. The ramp 40 thus radially offsets the leading and trailing portions 42 and 43 of the inner surface 34 from each other, and is therefore radially disposed between the leading and trailing portions 42 and 43. While the sidewall 33 has a generally constant thickness around much of its circumference, the leading portion 42 of the inner surface 34 is closer to the geometric center of the spacer 30 than is the trailing portion 43, because of this radial offset. The ramp 40, being formed to the sidewall 33, is formed as a radial protrusion or extension of the sidewall 33 which gradually diverts away from the constant radius of most of the sidewall 33 along arc A-B.

Circulation of coolant within the spacer 30 is imparted by the impeller 23, which is driven to rotate so as to impart rotational movement of coolant out of and around the impeller 23 and thus within the chamber 22 of the spacer 30. The chamber 22 is open at the front and rear faces 31 and 32 so that coolant may easily move into and through it. The coolant circulates in the direction indicated by arcuate arrowed lines X in FIGS. 4 and 5. When coolant circulates within the spacer 30, it encounters the leading portion 42 of the inner surface 34 before the trailing portion 43 of the inner surface 34. The leading portion 42 is a triangular section of the inner surface 34, mapped onto the annular sidewall 33 and defined proximate to the ramp 40. Its height between the front and rear faces 31 and 32 increases in the direction of the arrowed lines X generally toward the rear face 32. The leading portion 42 leads to the inner surface 34, which is a rectangular shape mapped onto the annular sidewall 33. The inner surface 34 extends to and terminates with the trailing portion 43, which is also a triangular section of the inner surface 34 mapped onto the annular sidewall 33. The height of the trailing portion 43 tapers, or decreases, in the direction of arrowed lines X generally toward the rear face 32.

Still referring to FIGS. 4 and 5, the ramp 40 radially offsetting the leading and trailing portions 42 and 43 is a helical surface disposed between the leading and trailing portions 42 and 43 at the front and rear faces 31 and 32, respectively. The ramp 40 has a leading edge 50 directed into the coolant circulation indicated by the arrowed lines X and an opposed trailing edge 51 directed away from the coolant circulation indicated by the arrowed lines X. The leading edge 50 is contiguous with the front face 31, while the trailing edge 51 is contiguous with the rear face 32, and they extend inwardly from the respective front and rear faces 31 and 32 to the leading portion 42 of the inner surface 34. The leading and trailing edges 50 and 51 are not both radially oriented with respect to the localized section of the inner surface 34 to which they are formed: while the trailing edge 51 is directed radially, the leading edge is directed slightly transverse to a radial or normal orientation with respect to the inner surface 34. In other words, one of the leading and trailing edges 50 and 51 is oriented radially with respect to the inner surface 34 of the sidewall 33, while the other of the leading and trailing edges 50 and 51 is not oriented inward with respect to the inner surface 34 of the sidewall 33 because it is slightly transverse to such an orientation. In some embodiments, however, the leading and trailing edges 50 and 51 are both radially oriented. Further, because they are contiguous with the front and rear faces 31 and 32, the leading and trailing edges 50 and 51 are flush and level to those faces 31 and 32, respectively, as well.

Between the leading and trailing edges 50 and 51, the ramp 40 has a ramp surface 53. The ramp 40 includes an arcuate or curvilinear inner edge 44 and an opposed arcuate or curvilinear outer edge 45 along the full length of the ramp 40 between the leading and trailing edges. In the embodiment shown in FIGS. 4-7, the inner and outer edges 44 and 45 are not equal in length, with the inner edge 44 being slightly shorter than the outer edge 45. In some embodiments, such as where the leading and trailing edges 50 and 51 are radially oriented with respect to the inner surface 34, and the ramp 40 is formed entirely along an arc having a constant radius, the inner edge 44 will be shorter than the outer edge 45. And in other embodiments, such as where either or both of the leading or trailing edges 50 or 51 are not radial and they are also directed slightly outward, the inner edge 44 will actually be longer than the outer edge 45. In the embodiment shown in FIG. 4, the ramp 40 has a width J extending between the inner and outer edges 44 and 45, which width J is preferably constant from the leading edge 50 to the trailing edge 51.

The ramp surface 53 is a smooth, helical, constant incline directed toward the rear surface 32. The ramp surface 53 pitches slightly inward toward the chamber 22. In other words, rather than extending from the inner surface 34 of the sidewall 33 in a normal direction, the ramp surface 53 is slightly pitched or canted: between the leading and trailing edges 50 and 51, the inner edge 44 is pitched toward or just slightly closer to the front face 31 than to the rear face 32. This unexpectedly produces a higher volumetric flow of coolant from the impeller 23 along the ramp surface 53. At the leading edge 50, the inner and outer edges 44 and 45 are both at the front face 31 and are each equidistant to the rear face 32. Similarly, at the trailing edge 51, the inner and outer edges 44 and 45 are both at the rear face 32 and are each equidistant to the front face 31. Thus, the inner edge 44 dips slightly toward the front face 31 so that the ramp surface 53 is pitched in the manner described above. In other words, the angle of the ramp surface 53 with respect to the inner surface 34 is not constant between the leading and trailing edges 50 and 51. In some embodiments, though, the angle of the ramp surface 53 is constant between the leading and trailing edges 50 and 51.

The ramp surface 53 is smooth but for a bore 54 formed through the ramp 40. The bore 54 is a cylindrical hole cutting entirely through the spacer 30 from the front face 31 to the ramp surface 53. The bore 54 is oriented perpendicular to the ramp surface 53, such that the mouth of the bore 54 at the front face 31 aligns with the vent opening in the face of the water pump 12, and the bore 54 extends through the spacer 30 in a transverse direction with respect to the orientation of the sidewall 33. The bore 54 improves the coolant flow within the chamber 22 and along the ramp 40.

Figure 6:
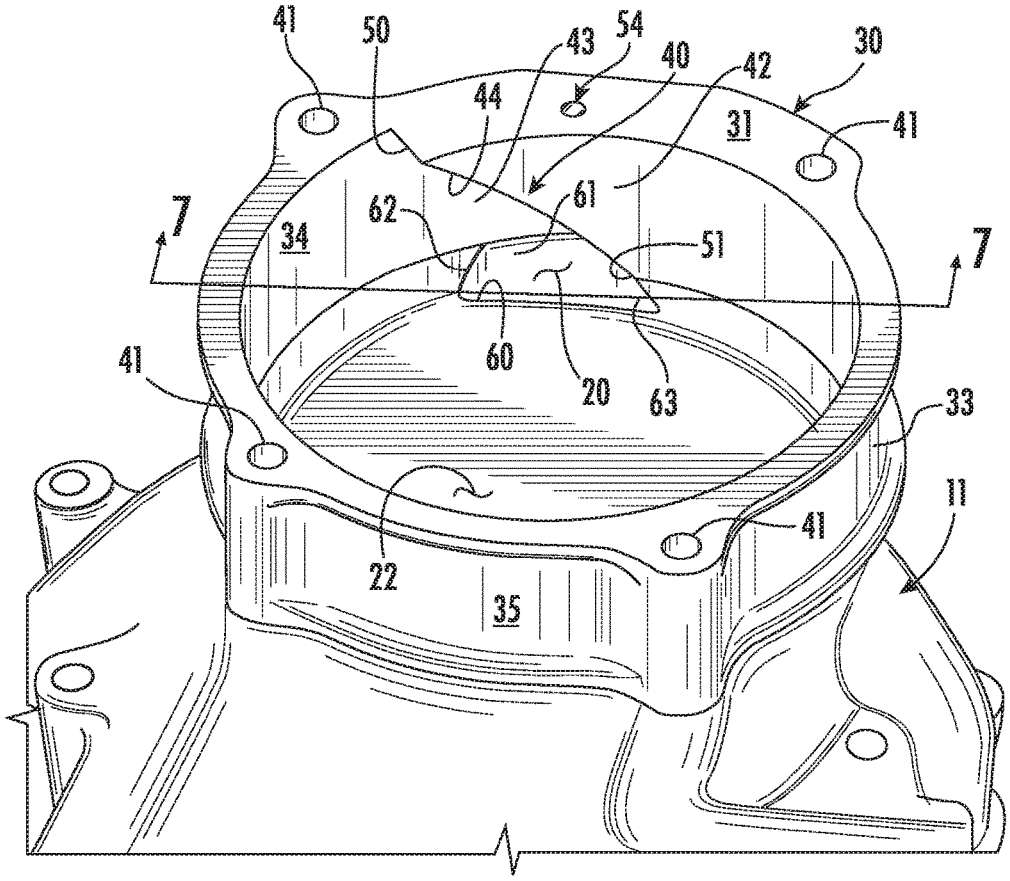
FIG. 6 is a front perspective view of the spacer of FIG. 2 applied to a timing chain cover.
Figure 7:
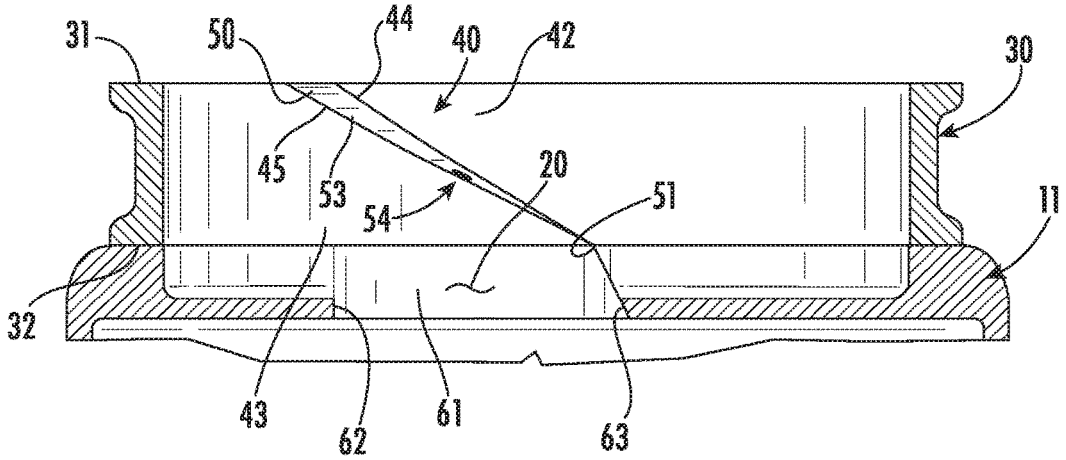
FIG. 7 is a section view of the spacer of FIG. 2 on a timing chain cover, taken along the line 7-7 in FIG. 6.

Turning now to FIGS. 6 and 7, the spacer 30 is illustrated applied to the timing chain cover 11 but without the water pump 12, with FIG. 6 providing a perspective view and FIG. 7 providing a section view taken along the line 7-7 in FIG. 6. The rear face 32 of the spacer 30 is set entirely in flush contact against the timing chain cover 11. Though not shown here, one having ordinary skill in the art will understand that bolts passed through the bores 41 will secure the spacer 30 to the timing chain cover 11. When the bolt pattern of the spacer 30 is properly matched to the bolt pattern on the timing chain cover 11, the ramp 40 is disposed to register with the volute entrance 20. The volute entrance 20, a hole formed through the wall of the timing chain cover 11, is an inlet into a system of passageways and conduits in the engine 10 through which coolant flows to cool the engine 10. The volute entrance 20 has an inner edge 60, an opposed outer side 61, a leading edge 62, and an opposed trailing edge 63. The volute entrance 20 is elongate about the circumference of the chamber 22, and as such, the inner edge 60 and outer side 61 are longer than the leading and trailing edges 62 and 63. The inner edge 60 is a radially outwardly-directed terminal edge of the wall of the timing chain cover 11 bounding the volute entrance 20, while the outer side 61 is an upstanding portion of the volute entrance 20 of the timing chain cover 11, which is aligned with the trailing portion 43 of the inner surface 34 of the sidewall 33. Between the inner edge 60 and the outer side 61, the leading and trailing edges 62 and 63 further define the volute entrance 20. The leading edge 62 is in front of the trailing edge 63 with respect to the rotation of the coolant in the chamber 22. The trailing edge 63 of the volute entrance 20 is proximate to and contiguous with the trailing edge 51 of the ramp 40: the ramp surface 53 twists in a helical fashion back toward the trailing edge 51, which terminates at the trailing edge 63, which is slightly upstanding, so that the trailing edge 51 of the ramp 40 actually terminates in front of the volute entrance 20. As such, coolant moving along the ramp 40 is directed smoothly into the volute entrance 20 proximate to the trailing edge 51 of the ramp 40 and ahead of the trailing edge 63 of the volute entrance 20.

As more clearly seen in FIG. 7 than in FIG. 6, the leading edge 50 of the ramp 40 corresponds to the leading edge 62 of the volute entrance 20. The leading edge 50, at the inner edge 44 of the ramp 40, is registered in front of the leading edge 62 of the volute entrance 20. The leading edge 50, at the outer edge 45 of the ramp 40, is slightly offset: it is rotationally forward of the inner edge 44, since the leading edge 50 is not radially directed inward from the inner surface 34. As such, the inner edge 44 of the ramp 40 has the same span or arc length as the inner edge 60 of the volute entrance 20, and the outer edge 45 of the ramp 40 has a just slightly greater span or arc length as the outer side 61 of the volute entrance 20. In other words, the span of the ramp 40 is approximately equal to the span of the volute entrance 20. The span of the ramp 40 is the length over an approximately 43 degree arc measure, which is the angular distance between the leading and trailing edges 50 and 51 of the ramp. In a preferred embodiment, the span of the ramp 40 is over a 43.2 degree arc measure. This correspondence between the spans of the ramp 40 and the volute entrance 20 unexpectedly produces a higher volume flow of coolant from the impeller 23 along the ramp surface 53: both shorter and longer spans produced less flow of coolant. Table A illustrates the flow of coolant through an engine 10 applied with the spacer 30 compared with that of an engine applied with a conventional spacer 13.

TABLE A

| RPM | 500 | 750 | 1000 | 1250* | 1500 | 1750* | 2000 | 2250* | 2500 |
|---|---|---|---|---|---|---|---|---|---|
| Coolant flow with spacer 30 (43.2 degree arc) (gallons per minute "GPM") | 0 | 8 | 12.5 | 17.3 | 22 | 25 | 28 | 31 | 34 |
| Coolant flow with conventional spacer 13 (GPM) | 0 | 0 | 7 | 11.6 | 16.3 | 20.4 | 24.5 | 27.8 | 31 |
| Percentage improvement | N/A | N/A | 78.6 | 49% | 35.0% | 22.5% | 14.3% | 11.5% | 9.7% |

*Values for these RPMs are interpolated from a best-fit line

As is seen in Table A, the spacer 30 allowed for more coolant flow through the engine 10 than the conventional spacer 13 at all engine speeds (in rotations per minute or "RPM"), other than 500 RPM. The increased volume of coolant led to a cooler engine 10 that does not overheat.

TABLE B

| RPM | 500 | 750 | 1000 | 1250* | 1500 | 1750* | 2000 | 2250* | 2500 |
|---|---|---|---|---|---|---|---|---|---|
| Coolant flow with spacer (21.6 degree arc) (GPM) | 0 | 6.8 | 11.5 | 16.3 | 21 | 24 | 27 | 30 | 33 |
| Coolant flow with conventional spacer 13 (GPM) | 0 | 0 | 7 | 11.6 | 16.3 | 20.4 | 24.5 | 27.8 | 31 |

TABLE B-continued

| RPM | 500 | 750 | 1000 | 1250* | 1500 | 1750* | 2000 | 2250* | 2500 |
|---|---|---|---|---|---|---|---|---|---|
| Percentage improvement | N/A | N/A | 64.3% | 40.5% | 28.8% | 17.6% | 10.2% | 7.9% | 6.5% |

*Values for these RPMs are interpolated from a best-fit line

Table B shows measurements for an alternate embodiment of the spacer 30 in which the ramp 40 had a span with a 21.6 degree arc measure, or half that of the ramp 40 in the FIGS. 2-7 and in Table A. While the spacer of Table B did produce more coolant flow volume than the conventional spacer, it did not produce as much as the Table A spacer 30. The incline of the ramp 40 between the front and rear faces 31 and 32 of this embodiment of the spacer is twice the incline of the ramp 40 on the spacer 30 of Table A.

TABLE C

| RPM | 500 | 750 | 1000 | 1250* | 1500 | 1750* | 2000 | 2250* | 2500 |
|---|---|---|---|---|---|---|---|---|---|
| Coolant flow with spacer (178 degree arc) (GPM) | 0 | 3 | 10 | 14 | 18 | 22 | 26 | 29.5 | 33 |
| Coolant flow with conventional spacer 13 (GPM) | 0 | 0 | 7 | 11.6 | 16.3 | 20.4 | 24.5 | 27.8 | 31 |
| Percentage improvement | N/A | N/A | 42.9% | 20.7% | 10.4% | 7.8% | 6.1% | 6.1% | 6.5% |

*Values for these RPMs are interpolated from a best-fit line

Table C shows measurements for another alternate embodiment of the spacer 30 in which the ramp 40 had a span with a 178 degree arc measure, or about four times that of the ramp 40 of the spacer 30 in the FIGS. 2-7 and in Table A. While the spacer of Table C did produce more coolant flow volume than the conventional spacer 13, it did not produce as much as the Table A spacer 30 or as much as the Table B spacer. The incline of the ramp 40 between the front and rear faces 31 and 32 of this embodiment of the spacer is about one fifth the incline of the ramp 40 on the spacer 30 of Table A.

When the spacer 30 is used in operation in an engine 10, coolant emitted from the water pump 12 and rotated by the impeller 23 in the chamber 22 contacts and moves along the ramp 40. The smooth ramp surface 53, the incline of the ramp 40, the slight inward pitch of the ramp surface 53, and the correspondence between the leading and trailing edges 50 and 51 of the ramp 40 and the leading and trailing edges 62 and 63 of the volute entrance 20, together with the other structures, elements, and characteristics described above, contribute to a spacer 30 that effectively communicates coolant into the volute entrance 20 so that engine overheating is prevented.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A spacer for coupling a water pump to a timing chain cover on an engine, the spacer comprising:

an upstanding sidewall with opposed front and rear faces, the upstanding sidewall bounding an interior chamber; and a ramp formed to the upstanding sidewall, the ramp extending into the interior chamber from the rear face to the front face;

wherein a bore extends through the upstanding sidewall from a ramp surface to the front face, the bore oriented transverse to the ramp surface.

2. The spacer of claim 1, wherein the ramp extends circumferentially on the upstanding sidewall, from the rear face to the front face in a helical direction.

3. The spacer of claim 1, wherein the ramp has opposed leading and trailing edges at the front and rear faces of the upstanding sidewall, respectively, and the ramp has a constant width between the leading and trailing edges.

4. The spacer of claim 1, wherein the ramp has opposed leading and trailing edges at the front and rear faces of the upstanding sidewall, respectively, and the ramp has an arc measure of approximately 43 degrees between the leading and trailing edges.

5. The spacer of claim 4, wherein the ramp has a constant incline between the leading and trailing edges of the ramp.

6. The spacer of claim 5, wherein the ramp further includes an inner edge directed into the interior chamber, where the inner edge is pitched toward the front face.

7. A spacer for coupling a water pump to a timing chain cover on an engine, the spacer comprising:

an upstanding sidewall with opposed front and rear faces;

an inner surface of the upstanding sidewall bounding an interior chamber; and a ramp formed to the upstanding sidewall, interrupting the inner surface so as to radially offset a leading portion of the inner surface from a trailing portion of the inner surface, the ramp disposed between the leading portion and the trailing portion of the inner surface;

wherein a bore extends through the upstanding sidewall from a ramp surface to the front face, the bore oriented transverse to the ramp surface.

8. The spacer of claim 7, wherein the ramp extends circumferentially on the upstanding sidewall, from the rear face to the front face in a helical direction.

9. The spacer of claim 7, wherein the ramp has opposed leading and trailing edges at the front and rear faces of the upstanding sidewall, respectively, and the ramp has a constant width between the leading and trailing edges.

10. The spacer of claim 7, wherein the ramp has opposed leading and trailing edges at the front and rear faces of the upstanding sidewall, respectively, and the ramp has an arc measure of approximately 43 degrees between the leading and trailing edges.

11. The spacer of claim 10, wherein the ramp has a constant incline between the leading and trailing edges.

12. The spacer of claim 11, wherein the ramp further includes an inner edge directed into the interior chamber, where the inner edge is pitched toward the front face.

13. A spacer for coupling a water pump to a timing chain cover on an engine, the spacer comprising:

an upstanding sidewall with opposed front and rear faces, the upstanding sidewall defining an interior chamber open at the front and rear faces; and a ramp formed to the upstanding sidewall, the ramp extending circumferentially along the upstanding sidewall in the interior chamber between leading and trailing edges;

wherein a bore extends through the upstanding sidewall from a ramp surface to the front face, the bore oriented transverse to the ramp surface.

14. The spacer of claim 13, wherein the ramp has a constant width between the leading and trailing edges.

15. The spacer of claim 13, wherein the ramp has an arc measure of approximately 43 degrees between the leading and trailing edges.

16. The spacer of claim 15, wherein the ramp has a constant incline between the leading and trailing edges of the ramp.

17. The spacer of claim 16, wherein the ramp further includes an inner edge directed into the interior chamber, where the inner edge is pitched toward the front face.

18. The spacer of claim 13, wherein:

one of the leading and trailing edges is oriented radially with respect to the upstanding sidewall; and the other of the leading and trailing edges is not oriented radially with respect to the upstanding sidewall.

* * * * *